US005216840A

United States Patent [19]

Andrews

[11] Patent Number: 5,216,840

[45] Date of Patent: Jun. 8, 1993

[54] RESILIENT FLUID TIGHT SEAL

[76] Inventor: Zenas B. Andrews, P.O. Box 2536, Pascagoula, Miss. 39569

[21] Appl. No.: 833,679

[22] Filed: Feb. 11, 1992

Related U.S. Application Data

[63] Continuation-in-part of Ser. No. 647,987, Jan. 30, 1991, Pat. No. 5,086,587.

[51] Int. Cl.[5] ..... E06B 7/16

[52] U.S. Cl. ..... 49/483.1; 49/368; 49/395; 114/117

[58] Field of Search ..... 49/483, 366, 368, 499, 49/498, 395; 114/117

[56] References Cited

U.S. PATENT DOCUMENTS

| | | | |
|---|---|---|---|
| 2,610,079 | 9/1952 | Lambert | 114/117 X |
| 2,778,072 | 1/1957 | Palisca | 49/489 X |
| 2,844,118 | 7/1958 | Kummerman | 114/117 X |
| 3,095,619 | 7/1963 | Peterson | 49/489 X |
| 3,126,591 | 3/1964 | Hamilton | 49/489 |

*Primary Examiner*—Philip C. Kannan
*Attorney, Agent, or Firm*—Rodger H. Flagg

[57] ABSTRACT

An apparatus for sealing a movable closure member about an access aperture located within a rigid structure. The movable closure member is sized to cover the access aperture and to provide access through the access aperture when open. A resilient elastomeric gasket is secured to one of the rigid structure or the movable structure to suit design and manufacturing preference. The resilient elastomeric gasket has a hollow cavity disposed within the elastomeric gasket, and the hollow cavity is sealed at each end to form a pressure-equalizing chamber therein. A convex protrusion is positioned on the elastomeric gasket to confront a flat stop positioned upon the other of the rigid structure or the movable structure when the movable structure is closed. A closure means is provided to bias the convex protrusion against the flat stop face with sufficient pressure to partially deform the resilient, elastomeric gasket. The elastomeric gasket and the flat stop may be retrofited onto existing water tight doors by securing the flat stop onto the knife edge; and by replacing the existing seal with the elastomeric gasket of the present invention. This invention is adapted for use on bulkhead type fluid tight doors, and upon fluid tight double opening doors, and hatch covers.

19 Claims, 6 Drawing Sheets

RESILIENT FLUID TIGHT SEAL

This patent application is a continuation-in-part of U.S. patent application Ser. No. 07/647,987, filed Jan. 30, 1991 which issued as U.S. Pat. No. 5,086,587 on Feb. 11, 1992, entitled: BALANCED BEAM LATCHING APPARATUS.

BACKGROUND OF THE INVENTION

Fluid tight doors often require extensive adjustments and readjustments in order to continuously maintain a fluid tight closure in a dynamic environment. Fundamental problems are the stiffness, or non-resiliency, of the existing door gasket; and the flexing and working of a ship's hull at sea, or on an aircraft in flight. This twisting and flexing often causes warping, which results in bulkhead or airframe knife edge bending. Knife edge flexing and bending causes uneven seating between the knife edge and the gasket. The result is the loss of a fluid tight seal when the door is closed and sealed.

Where the knife edge is secured to the fixed door frame, the gasket is secured to the movable door. Alternately, the knife edge may be secured to the movable door, and the gasket secured to the fixed door frame.

In order to overcome the warpage, and thereby seal the door, existing elastomeric gaskets require large handle latching torques to assure line-to-line contact between the gasket and knife edge. Existing gaskets rely upon a large mechanical compression force to firmly press the knife edge against the gasket to achieve a fluid tight seal.

There are three basic types of seals now in use: mechanical compression seals; flap seals; and self energizing seals.

Mechanical compression seals seal a fluid by forcing a blunt knife edge into a flat elastomeric gasket. The knife edge is usually made of metal and is typically attached to the fixed member, while the elastomeric gasket is generally secured to the movable member. Mechanical compression seals prevent fluid leakage across the seal from either direction. Fluid leakage will occur when the differential pressure across the seal exceeds the mechanical compression force used to press the knife edge against the gasket.

Flap seals comprise an elastomeric flap, generally attached to the movable member, which presses against the solid surface of the fixed member. Differential pressure across the seal causes the flap to press against the fixed member to prevent fluid leakage. Flap seals act as check valves, sealing the flap valve when the differential pressure is acting to press the flap valve against the fixed member. Flap valves do not seal effectively against differential pressure acting to push the flap valve away from the fixed member. Two opposing flap valves may be used in opposing configurations to seal against differential pressure acting from either direction.

Self-energizing seals, use differential fluid pressure across the seal to press the gasket against both the fixed and movable members. The elastomeric gasket is placed in compression between the fixed and movable members to form a pre-compression force, which remains a constant value that does not change as the differential pressure increases across the seal. As fluid pressure increases on the pressure side of the seal, the fluid pressure is transmitted throughout the elastomeric gasket, causing the attempted expansion of the elastomeric gasket against the inner and outer flat surfaces of the fixed and movable members. Since the inner and outer flat surfaces cannot move, the contact pressure increases in proportion to the fluid pressure on the pressure side of the gasket. The sum of the pre-compression force is added to the differential pressure on the seal, to assure a fluid tight seal.

The self-energizing seal is fluid tight for any value of differential pressure, and failure can only occur when the differential pressure exceeds the designed stress limits of the seal.

An O-ring utilizes this self-energizing principle in order to impart a sealing force when used to hydraulically seal a shaft. A pre-compression force is exerted between the fixed member, the O-ring and the movable member. Differential pressure is transmitted throughout the O-ring which forces the O-ring against one wall of the slot. Attempted expansion of the O-ring provides increased compression pressure between the inner and outer surfaces, resulting in a self-energizing fluid seal, utilizing both precompression and differential pressure forces.

The following prior art is representative of fluid tight seals used to seal a hatch or bulkhead:

U.S. Pat. No. 4,891,910 issued Jan. 9, 1990, entitled "Apparatus for sealing a door", discloses an elastomeric flat seal which seals against differential pressure by means of mechanical compression against a flat face.

U.S. Pat. No. 4,685,249, issued Aug. 11, 1987, entitled "Industrial Air Filter Door with Standard Handle-Dog Actuation", discloses a resilient oval cross section seal, which seals against differential pressure by mechanical compression forces acting between two flat surfaces.

U.S. Pat. No. 4,545,764 issued, Oct. 8, 1985, entitled "Rotary Kiln Assemblies, Method of Changing Seal Arrangements and Seal Arrangements for use in a Rotary Kiln Assembly", discloses two flap type seals mounted in an opposing configuration to seal against limited differential pressure acting from either side of the seal.

U.S. Pat. No. 4,523,407, issued Jun. 18, 1985, entitled "hatch Cover", discloses a self-energizing, hollow cavity, O-ring seal which is encased within a retainer. This O-ring functions as a face seal and is self-energizing under differential pressure. No claim or disclosure is provided, relating to the sealing of the ends of the cavity in order to build up an internal equalizing pressure within the cavity of the O-ring, when the O-ring is under compression.

U.S. Pat. No. 2,844,188 issued Jul. 22, 1958, entitled Water Tight Hatch Cover Arrangement, discloses a rectangular seal with an internal cavity, which is retained by a bead and biased from the side as shown in FIGS. 1 and 2. A projecting member engages the gasket to seal the hatch cover.

U.S. Pat. No. 3,043,257 issued Jul. 10, 1962, entitled FLUSH DECK HATCH COVER discloses a flush deck hatch cover having a resilient gasket with an internal aperture which is compressed against a flat stop to seal the hatch.

U.S. Pat. No. 2,964,304 issued Jul. 26, 1960, entitled HATCH COVER ASSEMBLY, discloses a hatch cover assembly having a central seal formed by resilient members each having an internal cavity, which abut each other to seal the hatch. See FIG. 5.

SUMMARY OF THE INVENTION

This invention provides a fluid tight, or hermetic seal between a movable member and a fixed member. More particularly, this invention pertains to a resilient fluid tight seal, or gasket, which is mounted onto a first member, such as the movable member, or closure, such as a door. The resilient fluid tight seal is pressed against a flat stop surface secured to a second member, such as a bulkhead opening, or access aperture. It is also within the scope of this invention to mount the resilient seal onto the second member, and the flat stop surface onto the first member.

The resilient, elastomeric gasket is preferably contained within a retainer which provides a resilient sealing face. A flat stop surface provides a rigid sealing face positioned to engage the resilient sealing face of the seal when the movable member is closed. The flat stop surface, or face, is preferably made of metal or other substantially rigid material. The flat stop face is preferably wider than the diameter of the circular cavity formed within the resilient, elastomeric gasket. The diameter of the hollow cavity may alternately be greater or smaller in size than the flat stop face.

The elastomeric gasket is resilient to accommodate irregularities in the distance between the fixed and movable members. The seal is self-energizing due to the differential fluid pressure across the seal. The resilient gasket disclosed herein does not require a large mechanical compression force between the movable member and the fixed member, in order to develop a fluid tight seal.

DESCRIPTION OF THE DRAWINGS

The above mentioned and other features and objects of this invention and the manner of attaining them will become more apparent and the invention itself will be best understood by reference to the following description of the invention taken in conjunction with the accompanying drawings, wherein.

DESCRIPTION OF THE PREFERRED EMBODIMENT

Figure 1:
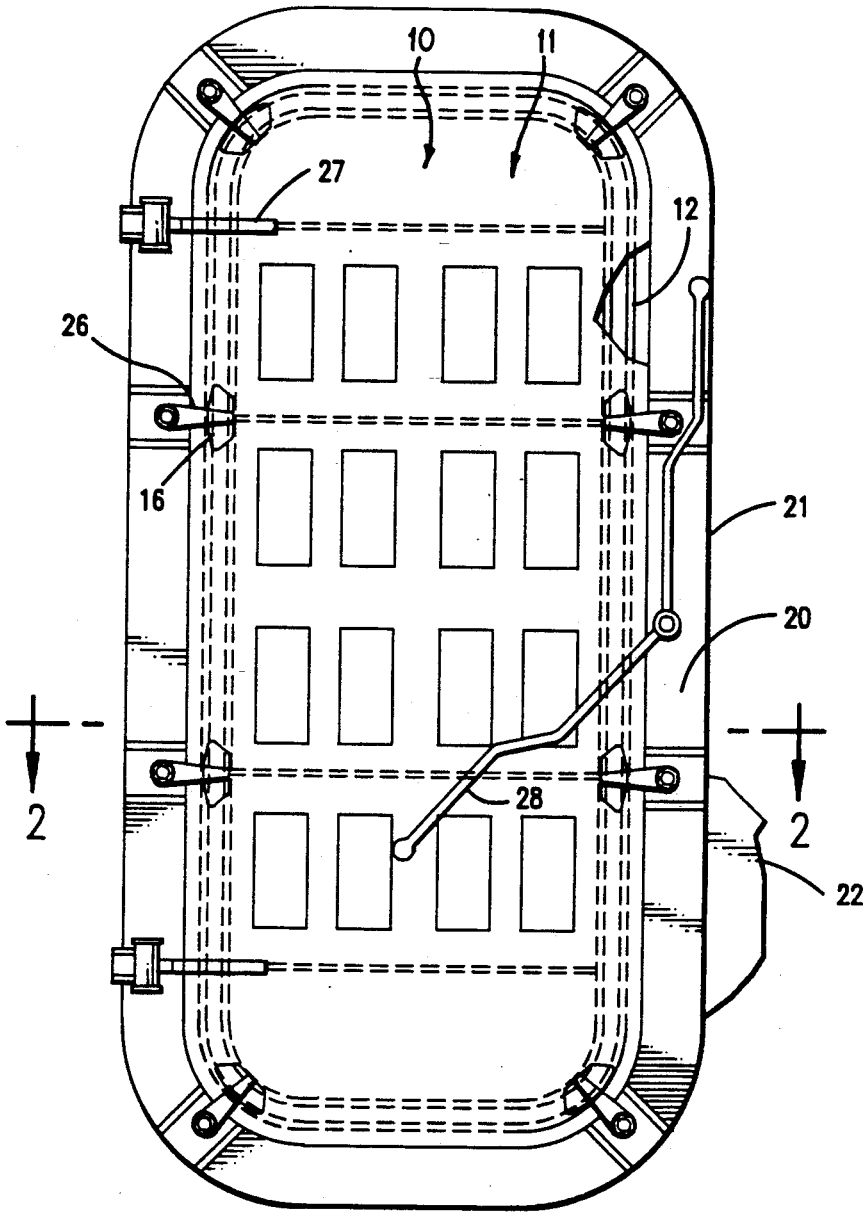
FIG. 1 is a front elevation view of a typical shipboard watertight door, door frame and bulkhead assembly.

As shown in FIG. 1, a typical ship's watertight door is shown having a movable member assembly 10 with a movable door 11 having a resilient elastomeric gasket 12 shown in dashed lines. A fixed member assembly 20 comprises a door frame 21 secured to a structural bulkhead 22. The door 11 is connected by a hinge 27 to the door frame 21.

A door latching mechanism 26 is typically mounted onto the fixed door frame 21, or mounted within the movable door, to suit manufacturing or design preference. The door latching mechanism comprises door latch wedges 16 located beneath door latch dogs 26 which are operatively connected by linkage 29 to a latch operating handle 28. Handle 28 is rotated to selectively latch or unlatch the door latch dogs 26. The door latch dogs 26 are biased by the door latch wedges 16 to force the resilient, elastomeric gasket 12 against the flat stop face 24. The BALANCED BEAM LATCHING APPARATUS, patented by applicant as U.S. Pat. No. 5,086,587, issuing on Feb. 11, 1992, discloses in detail one means of latching a door, which is intended to be incorporated by reference herein.

Figure 2:
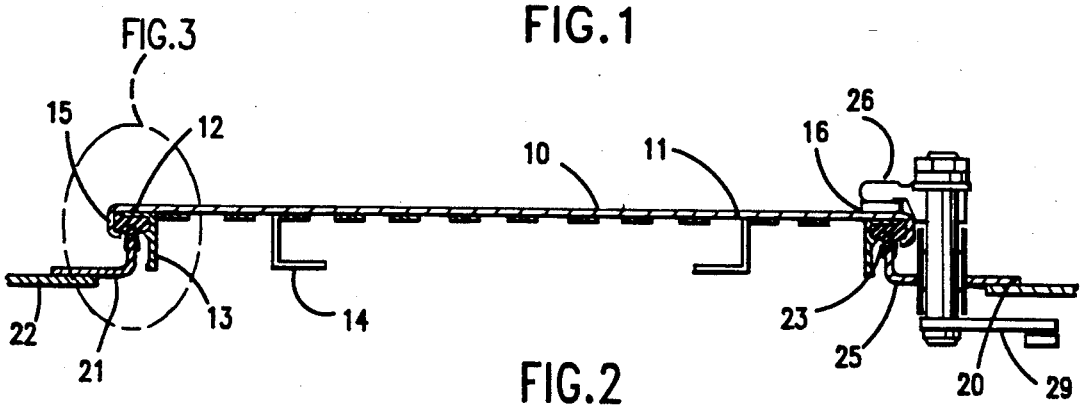
FIG. 2 is a cross sectional view of a movable watertight door and fixed bulkhead assembly shown in 2—2 in FIG. 1.

FIG. 2 shows a cross sectional view of the movable closure member assembly 10 shown in FIG. 1, with the watertight door 11 shown in closed position, wherein the elastomeric gasket 12 is compressed against the flat stop 23. Elastomeric Gasket 12 is retained between the door frame stiffeners 13 and gasket retainers 15, which extend about the access aperture located within the door frame 21. The door frame 21 is secured to the structural bulkhead 22. Flat stop supports 25 extend from the door frame 21 to support the flat stop 23 about the door aperture in alignment with the elastomeric gasket 12.

Figure 3:
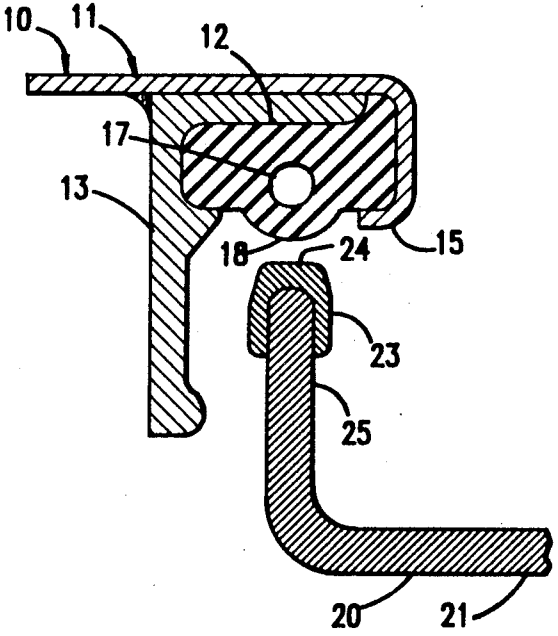
FIG. 3 is an enlarged cross sectional view of the resilient elastomeric gasket and flat stop shown in FIG. 2, prior to engagement of the flat stop with the elastomeric gasket.

FIG. 3 is an enlarged cross sectional view of the elastomeric gasket 12 supported by the frame stiffener 13 and the gasket retainer 15. A hollow cavity 17 extends beneath the convex gasket protrusion 18, about the entire circumference of the door access aperture. The hollow cavity 17 is preferably sealed at each end or sealed end to end to form a pressure equalizing chamber within the hollow cavity 17.

Figure 4:
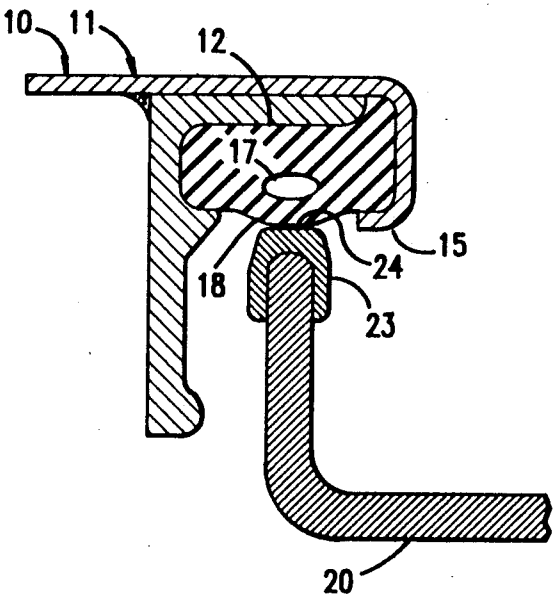
FIG. 4 is an enlarged cross sectional view of the resilient elastomeric gasket and flat stop shown in FIG. 3, with the flat stop in engagement with the elastomeric gasket.

The movable member 10 is spaced from the fixed member 20, in an open position, shown in FIG. 3. Flat stop supports 25 extend from the door frame 21 to support the flat stop 23 about the door aperture in alignment with the elastomeric gasket 12. Flat stop 23 has a flat confronting surface 24 positioned to engage the convex protrusion 18 on the elastomeric gasket 12, to at least partially compress the hollow cavity 17 when the fluid tight door is closed, as shown in FIG. 4.

Figure 5:
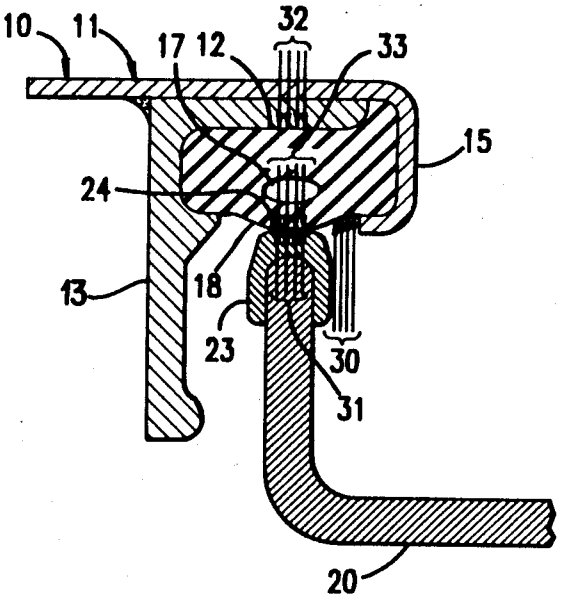
FIG. 5 is a cross sectional view showing the compression forces when the gasket is compressed against the flat stop and a differential pressure exists across the gasket.

FIG. 5 illustrates the basic self-energizing characteristic of applicant's invention. The greater pressure on one side of the resilient elastomeric gasket 12 is shown by arrows 30. This differential pressure force 30 is countered by two reaction forces shown by arrows 31 and 32. Reaction forces 31, 32 prevent expansion of the contained resilient elastomeric gasket 12, due to its containment between frame stiffener 13, gasket retainer 15 and flat stop face 24. The differential pressure occurs when a compartment on one side of the fluid tight door 11 is subjected to greater pressure than exists on the opposite side of the fluid tight door 11. Differential pressure across the resilient elastomeric gasket 12, increases the pressure on the seal between the elastomeric gasket 12 and the flat stop 24.

Differential pressure exists when a ship's compartment is flooded on one side of a closed fluid tight door. Differential pressure may also occur when the interior of an aircraft is pressurized, and the resilient elastomeric gasket 12 prevents leakage of pressurized air into the atmosphere.

The differential pressure increases the pressure force 30 which is imparted into the resilient elastomeric gasket 12. The forces increase proportionately, therefore the reaction forces 31, 32 are always equal to the pressure force 30.

The precompression force 33 is also imparted into the resilient elastomeric gasket 12 when the fluid tight door is compressed during latching. The total sealing force is the sum of the differential pressure force 30 plus the precompression force 33. Thus, the reaction forces 31, 32 will always exceed the differential pressure across the resilient elastomeric gasket 12. The result is a self energizing seal.

An additional equalizing force is provided by sealing the hollow cavity 17, to form a resilient chamber. The hollow cavity 17 may be sealed by sealing each end of the hollow cavity 17, or by joining the opposing ends of hollow cavity together, and sealing the resilient elastomeric gasket about the hollow cavity to create a continuous fluid path through the hollow cavity 17.

As the flat stop 23 presses against the convex protrusion 18, the hollow cavity 17 is at least partially compressed, and the resulting internal fluid pressure within the resilient chamber is equalized within the hollow cavity 17, overcoming uneven pressure caused by warping, misalignment or wear, between the fixed and movable members.

Figure 6:
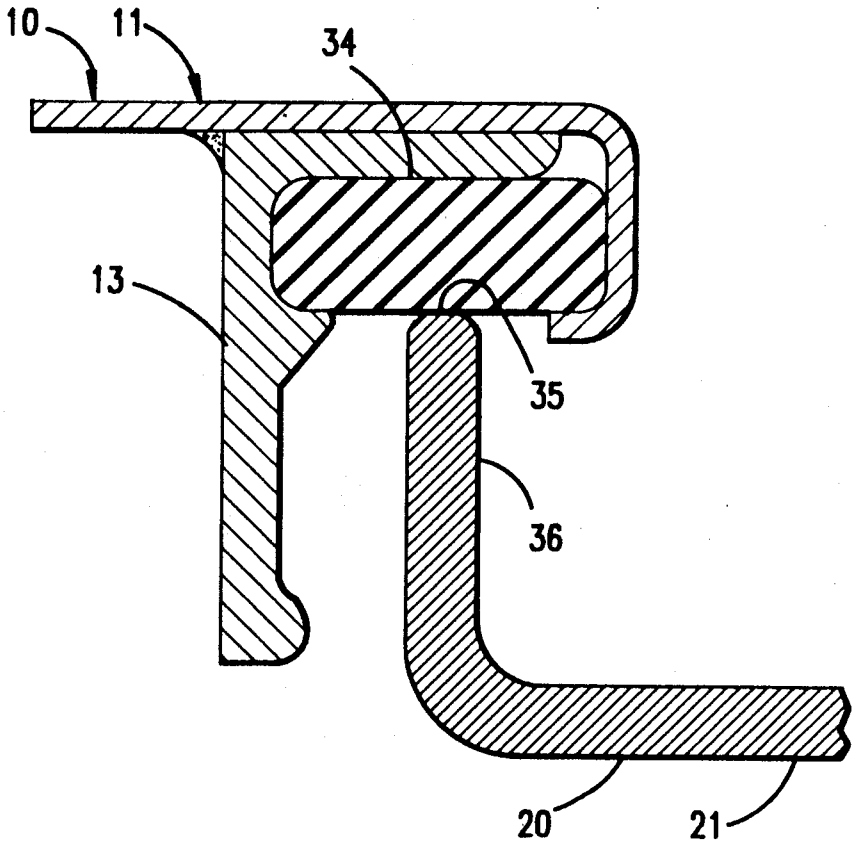
FIG. 6 PRIOR ART
FIG. 6 is a sectional view of a conventional door gasket having a blunt knife edge which is mechanically compressed against the door gasket, which is typical of existing naval shipboard watertight door and bulkhead seals.

FIG. 6 illustrates a conventional shipboard watertight door having a mechanical compression seal. The movable 10 and fixed members 20 shown in FIG. 6 are similar in configuration to the fluid tight door seals presently installed in new construction on ships of the U.S. Navy.

Existing water tight doors may be retrofited with the resilient elastomeric gasket 12 and flat stop 23 disclosed herein.

Figure 7:
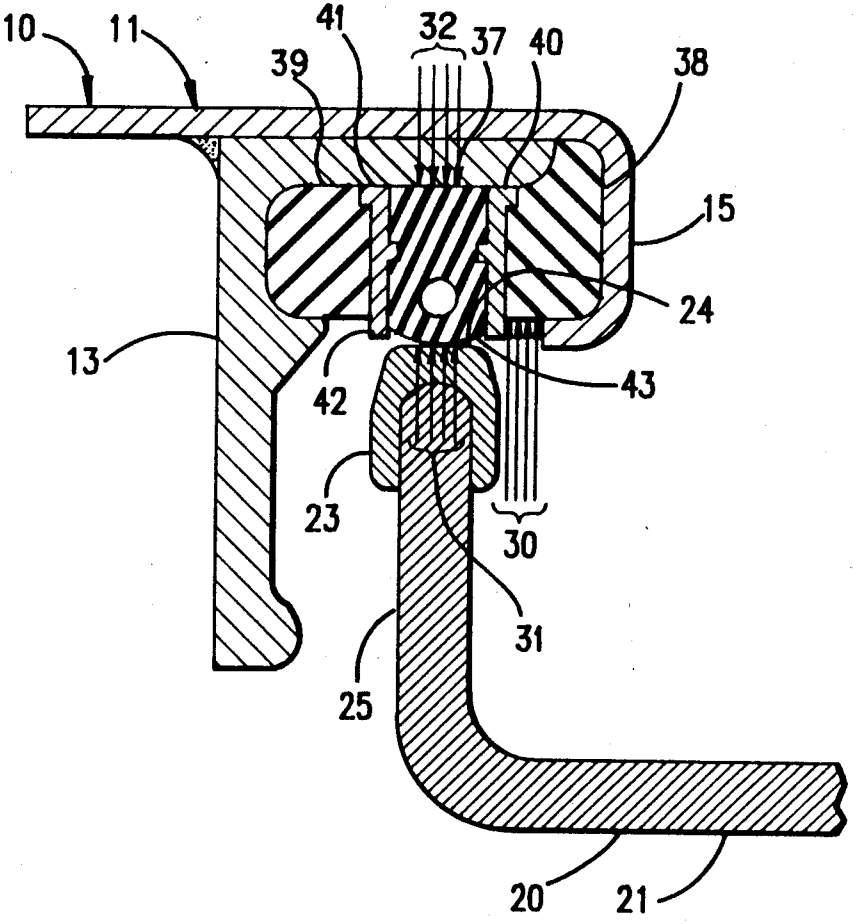
FIG. 7 is a sectional view of a three part resilient elastomeric gasket and flat stop assembly.

FIG. 7 discloses a cross-sectional view of a three part resilient elastomeric gasket 37 having two elastomeric spacers 38 and 39. This self-energizing assembly represents an alternative to the resilient elastomeric gasket 12 shown in FIG. 3.

Anti-extrusion rings 40, 41 serve to retain the three part elastomeric spacers within the frame stiffener 13 and the gasket retainer 15. A hollow cavity 42 and a convex gasket protrusion 43 are preferably included for added resiliency.

The anti-extrusion rings 40, 41 each have ribbed protrusions in order to effectively lock the three part gasket assembly within the gasket retainer 15 and the frame stiffener 13.

The resilient elastomeric gasket 37 shown in FIG. 7 is self energizing. The greater pressure shown by the force arrows 30 serve to compress one of the elastomeric gasket spacers 38 or 39. Since the spacers 38, 39 are confined within the gasket retainer 15 and the frame stiffener 13, the gasket spacer affected by force arrows 30 presses against the adjacent anti-extrusion ring 40 or 41, which in turn presses against the resilient elastomeric gasket 37. The differential pressure 30 is thereby distributed through the resilient elastomeric gasket, and the elastomeric gasket spacers 38 and 39. This differential pressure 30 is countered by reaction forces 31 and 32, resulting in increased pressure between the resilient elastomeric gasket 37 and the flat stop 23.

Figure 8:
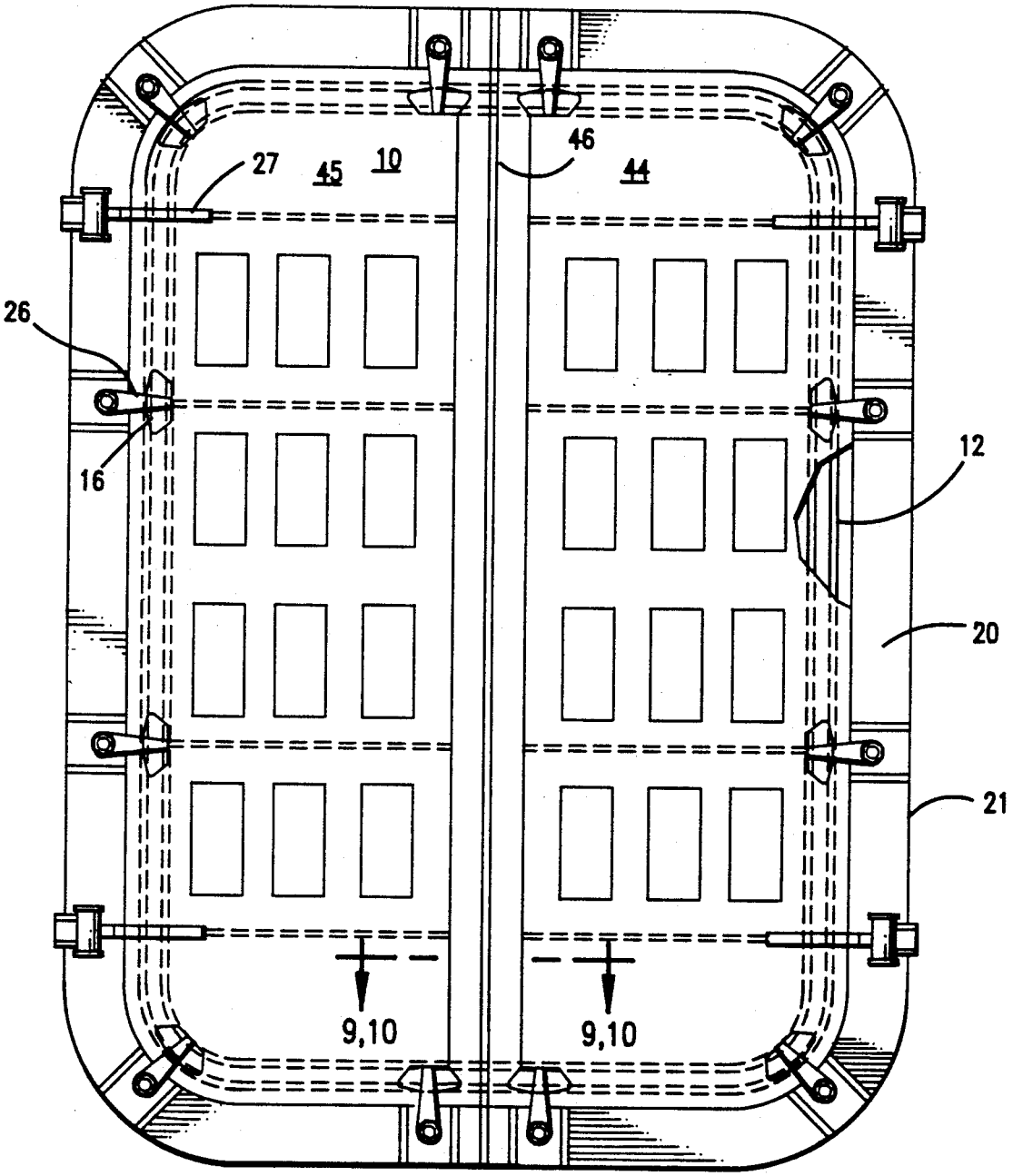
FIG. 8 is a plan view of a double opening door and door frame.

FIG. 8 is a plan view of a typical double opening fluid tight door or hatch, such as a shipboard cargo hatch. This view is similar in concept to the watertight door shown in FIG. 1, except that this door is split into two door halves, both of which include movable members 10.

These door halves are designated left and right half, double opening doors 44, 45. The resilient elastomeric gasket 12 surrounds the three sides of each double opening door 44, 45. A door frame 21 surrounds doors 44, 45, and the left and right doors 44 and 45 are hinged 27 to door frame 21. Door latches 26 are shown positioned around the outer perimeter of the double doors 44, 45. The latching mechanism may be any latching mechanism known in the art. Thus, the latching mechanism is not specifically disclosed or claimed herein.

Figure 9:
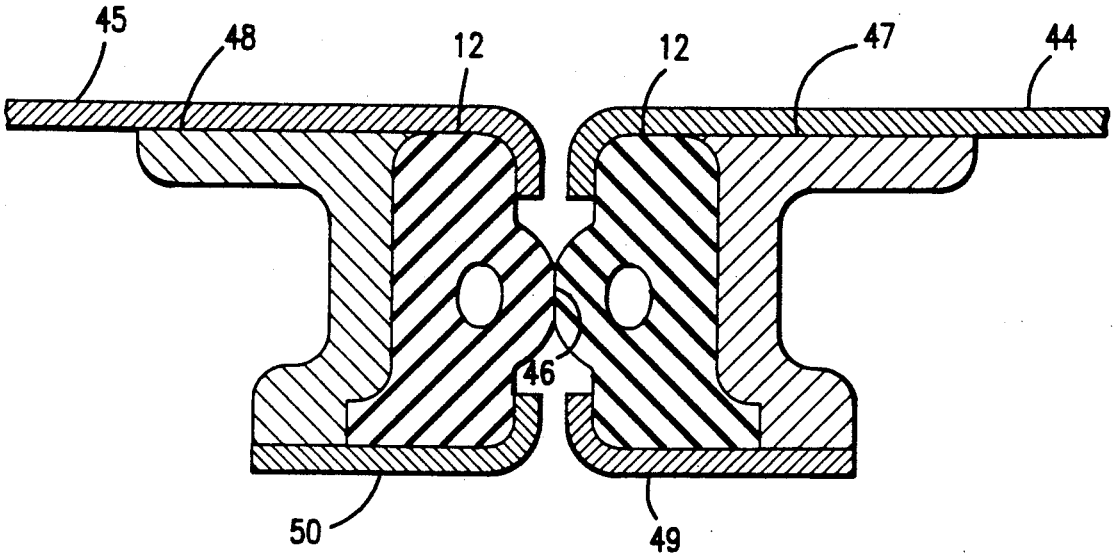
FIG. 9 is a sectional view of the center section of the double opening door taken along lines in 9—9 FIG. 8.

The double opening door center seam 46 is best shown in FIG. 9. Two resilient elastomeric gaskets 12 are compressed together when the double opening, right 44 and left 45 door halves are closed in order to provide a fluid tight seal. Door panel stiffeners 47, 48 and gasket retainers 49, 50 serve to retain elastomeric members 12*a* and 12*b*. Protrusions 46 abut each other to provide a sealing force between door halves 44, 45. A hollow cavity 17 within elastomeric members 12*a* and 12*b* serve to equalize pressure within the cavity when the ends of the cavity are sealed, as previously disclosed.

Latching compression of the three peripheral sides will cause increased fluid pressure within the hollow cavity 17 along the center seam 46. This will result in expansion of the resilient elastomeric gasket 12, which will thereby increase the compression sealing force between the right and left hand gasket protrusions 46.

Figure 10:
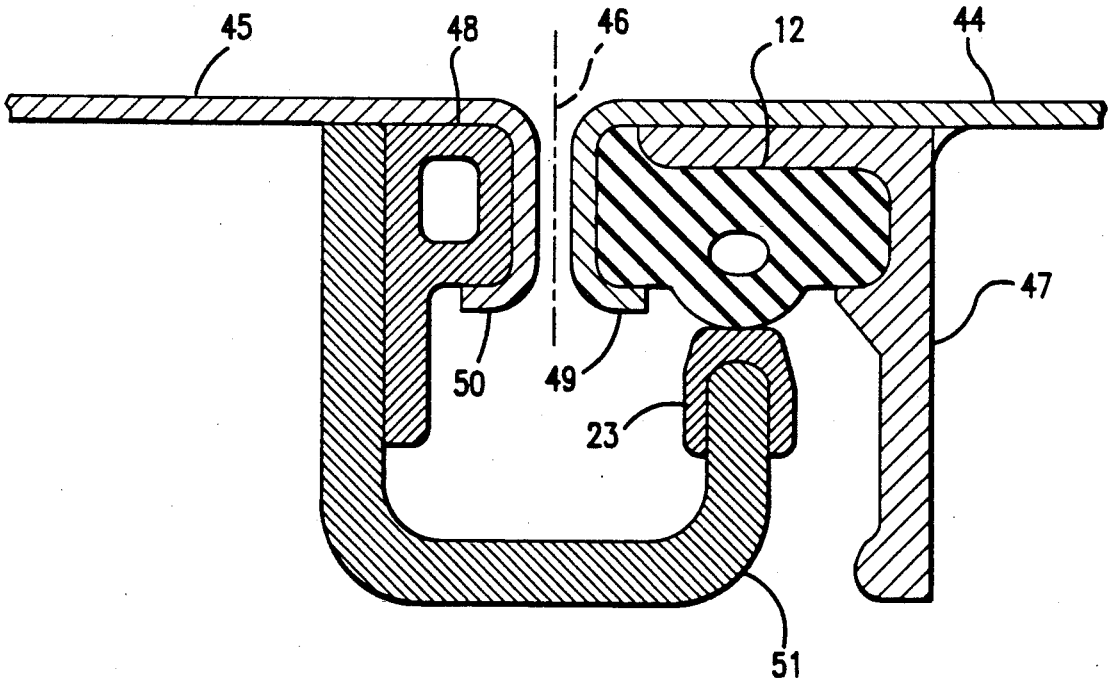
FIG. 10 is an alternate sectional view of the center section of the double opening door taken along lines 10—10 in FIG. 8.

FIG. 10 is a sectional view of an alternate embodiment of the double hatch shown in FIGS. 8 and 9. Elastomeric Gasket 12 is similar to the gasket shown in FIGS. 3 and 4. Flat stop support 51 secures flat stop 23 to door 45, and elastomeric gasket 12 is secured to door 44 by door stiffener 47 and gasket retainer 49. When door 44 is closed and secured against door 45, the elastomeric seal works in a similar manner to that disclosed in FIG. 4. The remaining sides of door 44, 45 are sealed with an elastomeric seal as shown in FIG. 4.

Figure 11:
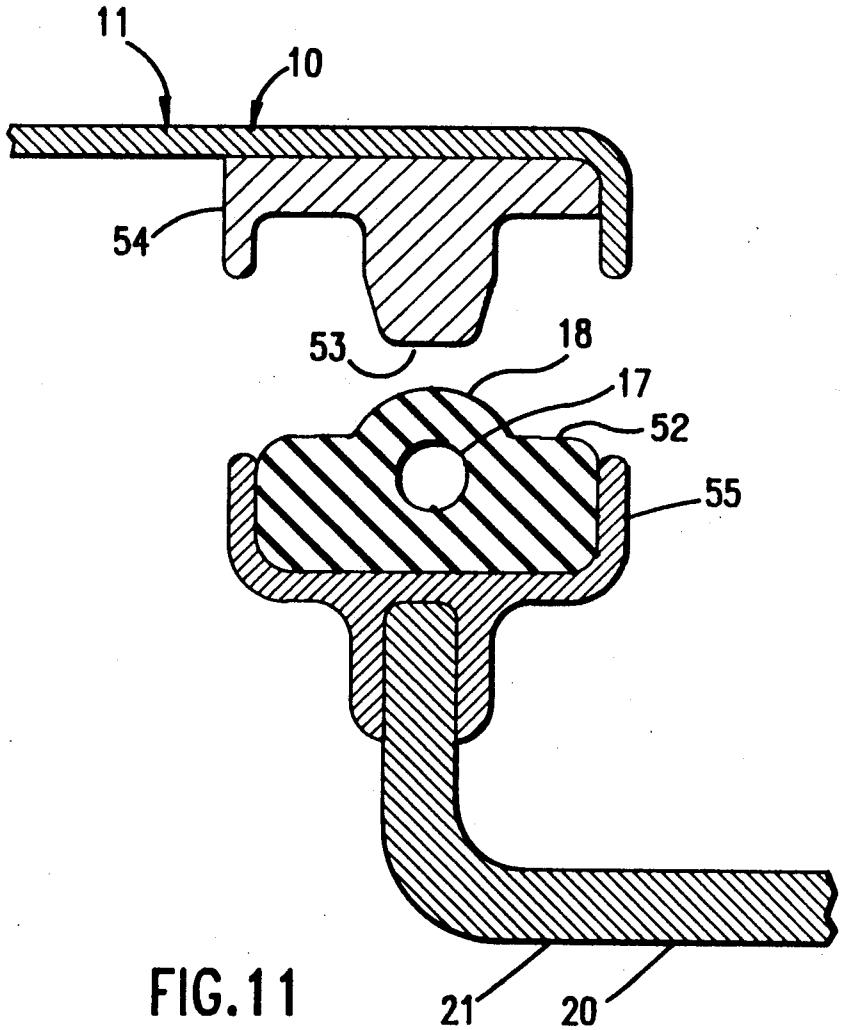
FIG. 11 is a sectional view of a flat stop attached to the movable member, while the resilient elastomeric gasket is attached to the fixed member.

FIG. 11 is a sectional view of a flat stop attached to the movable member, while the resilient elastomeric gasket is attached to the fixed member.

Figure 12:
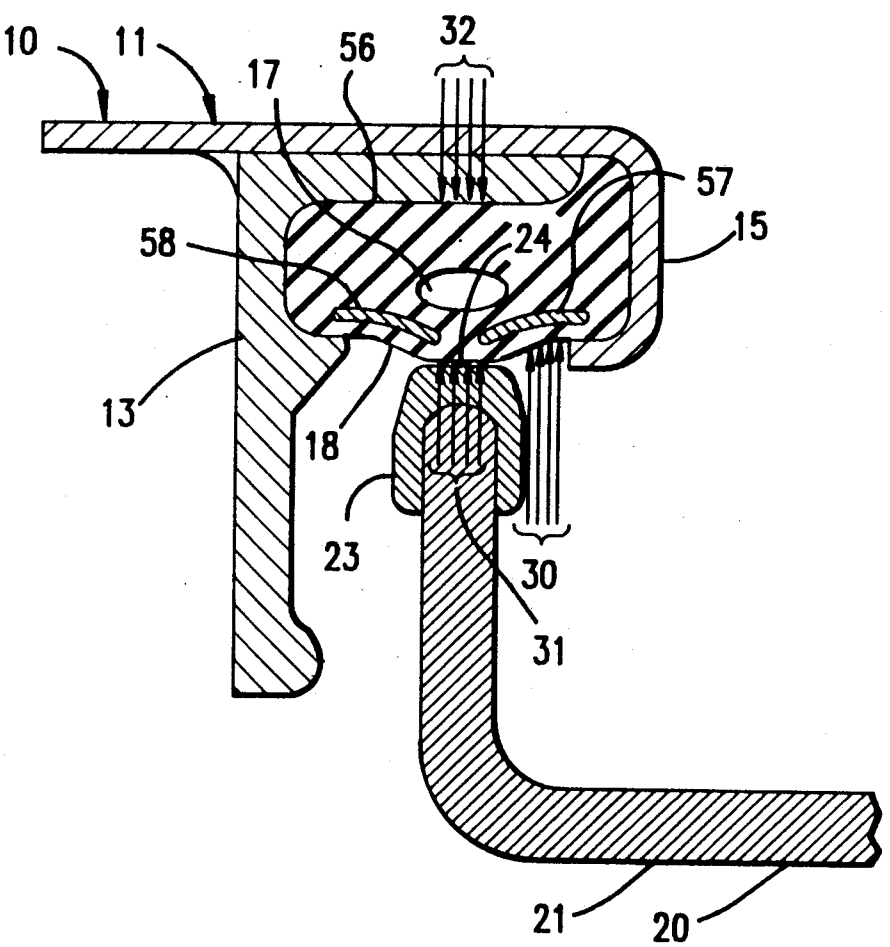
FIG. 12 is a cross sectional view of a modified resilient elastomeric gasket incorporating two blocking inserts.

FIG. 12 illustrates a modified resilient elastomeric gasket 56 which is similar to the resilient elastomeric gasket 12, shown in FIGS. 3 and 5. Movable members 10 are compressed under differential pressure against the fixed members 20, therefore differential pressure is imparted into the modified resilient elastomeric gasket 56. This modification comprises the insertion of two blocking inserts 57 and 58 into the resilient elastomeric gasket 12.

The differential pressure force 30 lifts the blocking insert, pressurized side 57 and thereby imparts pressure throughout the modified resilient elastomeric gasket 56. This pressure force 30 is then exerted against the gasket retainer 15, the door frame stiffener 13, the flat stop face 24 and the blocking insert, un-pressurized side 58. Reaction sealing forces 31 and 32 are shown in FIG. 5.

The objective of the blocking insert, un-pressurized side 58 is to bridge between the flat stop 23 and the gasket retainer 13, to prevent the loss of differential pressure 30. This loss could occur by bulging of the installed resilient elastomeric gasket 12, on the unpressurized side. Bulging or deformation of the resilient elastomeric gasket 12 between the flat stop 23 and the gasket retainer 13, could result in the loss or reduction of differential pressure 30 within the gasket 12. Therefore, the addition on the blocking inserts 57 and 58, more positively assures a self-energizing sealing force between the modified elastomeric gasket 56 and the flat stop 23. It is also to be noted that if the differential pressure force 30 occurs on the opposite side of the flat stop 23, the functions of the blocking inserts 57 and 58 are reversed.

Thus, while the improved resilient fluid tight seal has been fully described and disclosed, numerous modifications will become apparent to one of ordinary skill in this art, and such adaptations and modifications are intended to be included within the scope of the following claims.

What I claim is:

1. An apparatus for sealing a movable closure member about an access aperture in a rigid structure, which comprises:

a) a movable closure member sized to cover the access aperture when closed, and to provide access through the access aperture when open;

b) a resilient, elastomeric gasket secured to the movable closure member about the access aperture, with a convex gasket protrusion extending about the access aperture in confronting relation to the rigid structure surrounding the access aperture;

c) a flat stop face positioned on the rigid structure to abut the convex gasket protrusion as the movable closure member is closed;

d) a closure means for biasing the convex gasket protrusion against the flat stop face with sufficient pressure to at least partially deform the convex gasket protrusion by means of a precompression force exerted by the closure means as the convex gasket protrusion is biased against the flat stop face; and e) a hollow cavity disposed within the elastomeric gasket beneath the convex gasket protrusion, the hollow cavity sealed at the ends to provide an internal equalizing fluid pressure substantially about the access aperture to provide a uniform force distribution between the flat stop face and the convex gasket protrusion.

2. The apparatus of claim 1, wherein the hollow cavity in the elastomeric gasket is a cylindrical cavity of substantially uniform circular cross section.

3. The apparatus of claim 1, wherein the flat stop is secured to the movable closure member, substantially about the access aperture and positioned to align with the convex gasket protrusion extending from the fixed member, and the flat stop face is sized to be greater in width than the uncompressed width of the hollow cavity.

4. The apparatus of claim 1, wherein the elastomeric gasket is positioned adjacent to a frame stiffener secured to the rigid structure, and retained by a gasket retainer secured to at least one of the frame stiffener and the rigid structure.

5. The apparatus of claim 4, wherein the resilient elastomeric gasket comprises an elastomeric gasket having a convex raised portion extending substantially about the access aperture in confronting relation with the movable closure, with a hollow cavity extending beneath the convex raised portion; opposing first and second anti-extrusion rings disposed on each side of the elastomeric gasket; a first elastomeric gasket spacer disposed between the frame stiffener and the first anti-extrusion ring, and a second elastomeric gasket spacer disposed between the second opposing anti-extrusion ring and the gasket retainer.

6. The apparatus of claim 5, wherein the opposing first and second anti-extrusion rings each have opposing outwardly extending protrusions, and opposing inwardly extending protrusions sized to resist removal of the elastomeric gasket from the first and second elastomeric gasket spacers.

7. The apparatus of claim 5, wherein the first and second elastomeric gasket spacers and the elastomeric gasket are extruded.

8. The apparatus of claim 1, wherein the movable closure member comprises a single hinged door secured to the rigid structure in close proximity to the access aperture.

9. The apparatus of claim 1, wherein the movable closure member comprises opposing hinged doors secured in close proximity to opposing sides of the access aperture, and a fluid tight seal also extends between the abutting edges of the opposing hinged doors.

10. An apparatus for sealing a movable closure member about an access aperture which is located within a rigid structure, which comprises:

a) a movable closure member sized to cover the access aperture when closed, and hinged near one side of the access aperture to provide access through the access aperture when open;

b) a resilient, elastomeric gasket secured to the rigid structure about the access aperture;

c) a convex gasket protrusion extending in confronting alignment with the movable closure member about the access aperture, with a hollow cavity extending beneath the convex gasket protrusion; the ends of the hollow cavity in the elastomeric gasket sealed to provide an internal equalizing pressure within the hollow cavity;

d) a flat stop having a flat face and sides, the flat stop face positioned on the movable closure member to abut the convex gasket protrusion as the movable closure member is closed;

e) a primary closure means for biasing the convex gasket protrusion against the flat stop face with sufficient compression pressure to at least partially deform the hollow cavity to exert a pre-compression force against the convex gasket protrusion;

wherein the first fluid pressure within the sealed hollow cavity provides a uniform force distribution between the flat stop face and the convex gasket protrusion, and a secondary pressure means acting against opposite sides of the elastomeric gasket produces a fluid type seal between the movable closure member and the rigid structure surrounding the access aperture which supplements the compression sealing force exerted by the primary closure means.

11. The apparatus of claim 10, wherein the hollow cavity in the elastomeric gasket is a cylindrical cavity of substantially uniform circular cross section.

12. The apparatus of claim 10, wherein the elastomeric gasket is extruded of a substantially uniform cross-sectional profile.

13. The apparatus of claim 10, wherein the flat stop face is secured to the rigid structure substantially about the access aperture and positioned to align with the convex gasket protrusion, and the flat stop face is sized to be greater in width than the uncompressed width of the hollow cavity.

14. The apparatus of claim 10, wherein the elastomeric gasket is positioned adjacent to a frame stiffener secured to the movable closure, and retained by a gasket retainer secured to the frame stiffener.

15. The apparatus of claim 14, wherein the resilient elastomeric gasket comprises an elastomeric gasket having a convex raised portion extending substantially about the access aperture, with a hollow cavity extending beneath the convex raised portion; opposing anti-extrusion rings disposed on each side of the elastomeric gasket; and a first elastomeric gasket spacer disposed between the frame stiffener and one of the opposing anti-extrusion rings, and a second elastomeric gasket spacer disposed between the other opposing anti-extrusion ring and the gasket retainer.

16. The apparatus of claim 15, wherein the opposing anti-extrusion rings each have opposing outwardly extending protrusions, and opposing inwardly extending protrusions sized to resist removal of the elastomeric gasket from the first and second elastomeric gasket spacers.

17. The apparatus of claim 15, wherein the first and second elastomeric gasket spacers and the elastomeric gasket are extruded.

18. An apparatus for sealing a movable closure member about an access aperture located within a rigid structure, which comprises:

a) a movable closure member sized to cover the access aperture when closed, and to provide access through the access aperture when opened;

b) a flat stop having a flat stop face extending about the access aperture;

c) a resilient, elastomeric gasket secured to the movable closure member about the access aperture, with a convex gasket protrusion extending in confronting alignment with the flat stop face as the movable closure member is closed;

d) a primary closure force for biasing the flat stop face against the convex gasket protrusion with sufficient mechanical force to at least partially exert a pre-compression force against the convex gasket protrusion; and wherein an external fluid pressure on one side of the elastomeric gasket is greater than the external fluid pressure on the opposite side of the elastomeric gasket to provide a combined pre-compression force and a secondary fluid pressure force having a combined pressure greater than the fluid pressure force exerted upon one side of the elastomeric gasket.

19. The apparatus of claim 18, wherein a hollow cavity is disposed within the elastomeric gasket and the ends of the hollow cavity are sealed to provide a fluid chamber having an internal equalizing pressure therein.

* * * * *